US008570222B2

(12) United States Patent
Alexopoulos et al.

(10) Patent No.: US 8,570,222 B2
(45) Date of Patent: Oct. 29, 2013

(54) ANTENNA STRUCTURES AND APPLICATIONS THEREOF

(75) Inventors: Nicolaos G. Alexopoulos, Irvine, CA (US); Yunhong Liu, San Juan Capistrano, CA (US); Seunghwan Yoon, Costa Mesa, CA (US)

(73) Assignee: Broadcom Corporation, Irvine, CA (US)

( * ) Notice: Subject to any disclaimer, the term of this patent is extended or adjusted under 35 U.S.C. 154(b) by 984 days.

(21) Appl. No.: 12/642,360

(22) Filed: Dec. 18, 2009

(65) Prior Publication Data

US 2010/0177001 A1 Jul. 15, 2010

Related U.S. Application Data

(60) Provisional application No. 61/145,049, filed on Jan. 15, 2009.

(51) Int. Cl.
*H01Q 1/38* (2006.01)
*H01Q 9/28* (2006.01)

(52) U.S. Cl.
USPC ..... 343/700 MS; 343/795

(58) Field of Classification Search
USPC ..... 343/700 MS, 793, 795
See application file for complete search history.

(56) References Cited

U.S. PATENT DOCUMENTS

| | | | | |
|---|---|---|---|---|
| 5,801,660 | A | 9/1998 | Masataka | |
| 6,285,342 | B1 * | 9/2001 | Brady et al. | 343/895 |
| 7,202,822 | B2 * | 4/2007 | Baliarda et al. | 343/700 MS |
| 7,761,115 | B2 * | 7/2010 | Castaneda et al. | 455/562.1 |
| 8,188,926 | B2 * | 5/2012 | Ganwani et al. | 343/700 MS |
| 2003/0222821 | A1 | 12/2003 | Mikkonen | |
| 2004/0160368 | A1 | 8/2004 | Huang | |
| 2006/0256018 | A1 | 11/2006 | Jordi | |
| 2010/0177001 | A1 | 7/2010 | Alexopoulos | |

FOREIGN PATENT DOCUMENTS

WO 2004095635 A1 11/2004

OTHER PUBLICATIONS

European Search Report; Application No. 10015737.9-2220; Apr. 8, 2011; 4 pages.

Crnojevic-Bengin V.; "Compact 2D Hilbert Microstrip Resonators"; Microwave and Optical Technology Letters; vol. 48, No. 2; Feb. 2006; pp. 270-273.

Vesna Crnojevic-Bengin and Djuradj Budimir; Novel 3D Hilbert Microstrip Resonators; 2005 Microwave and Optical Technology Letters; Aug. 5, 2005; pp. 195-197; vol. 46, No. 3; Wiley Periodicals, Inc.

* cited by examiner

*Primary Examiner* — Tan Ho

(74) *Attorney, Agent, or Firm* — Garlick & Markison; Bruce E. Garlick

(57) ABSTRACT

An antenna apparatus includes a substrate and an antenna structure. The antenna structure includes a metal trace and a terminal. The metal trace has a modified Polya curve shape that is confined in a polygonal shape. The terminal is coupled to the metal trace.

20 Claims, 12 Drawing Sheets device 10

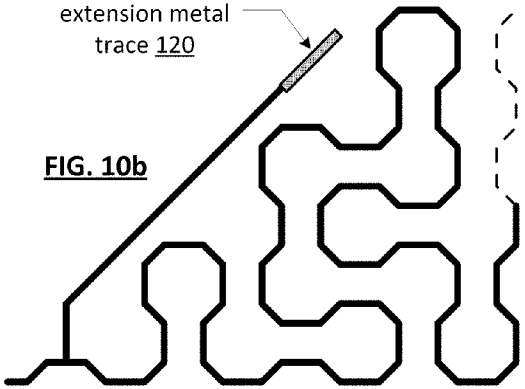
FIG. 10b
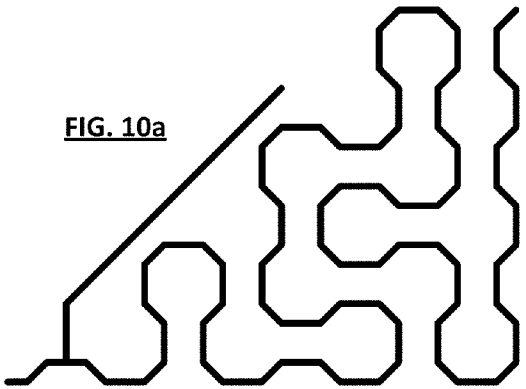
FIG. 10a
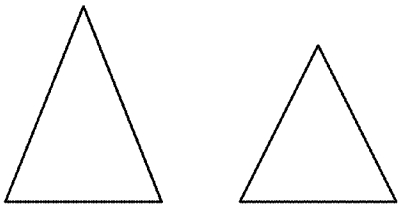
FIG. 11a
FIG. 11b
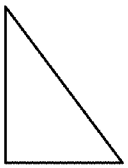
FIG. 11c
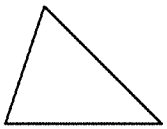
FIG. 11d
FIG. 11e
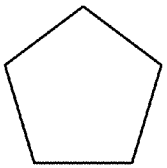
FIG. 11f
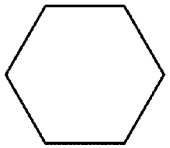
FIG. 11g
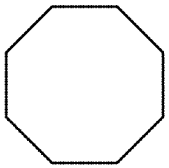
FIG. 11h

ANTENNA STRUCTURES AND APPLICATIONS THEREOF

This patent application is claiming priority under 35 USC §119 to a provisionally filed patent application entitled ANTENNA STRUCTURE AND OPERATIONS, having a provisional filing date of Jan. 15, 2009, and a provisional Ser. No. 61/145,049.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Technical Field of the Invention

This invention relates generally to wireless communication systems and more particularly to antennas used in such systems.

2. Description of Related Art

Communication systems are known to support wireless and wire lined communications between wireless and/or wire lined communication devices. Such communication systems range from national and/or international cellular telephone systems to the Internet to point-to-point in-home wireless networks to radio frequency identification (RFID) systems. Each type of communication system is constructed, and hence operates, in accordance with one or more communication standards. For instance, radio frequency (RF) wireless communication systems may operate in accordance with one or more standards including, but not limited to, RFID, IEEE 802.11, Bluetooth, advanced mobile phone services (AMPS), digital AMPS, global system for mobile communications (GSM), code division multiple access (CDMA), WCDMA, local multi-point distribution systems (LMDS), multi-channel-multi-point distribution systems (MMDS), LTE, WiMAX, and/or variations thereof. As another example, infrared (IR) communication systems may operate in accordance with one or more standards including, but not limited to, IrDA (Infrared Data Association).

Depending on the type of RF wireless communication system, a wireless communication device, such as a cellular telephone, two-way radio, personal digital assistant (PDA), personal computer (PC), laptop computer, home entertainment equipment, RFID reader, RFID tag, et cetera communicates directly or indirectly with other wireless communication devices. For direct communications (also known as point-to-point communications), the participating wireless communication devices tune their receivers and transmitters to the same channel or channels (e.g., one of the plurality of radio frequency (RF) carriers of the wireless communication system) and communicate over that channel(s). For indirect wireless communications, each wireless communication device communicates directly with an associated base station (e.g., for cellular services) and/or an associated access point (e.g., for an in-home or in-building wireless network) via an assigned channel. To complete a communication connection between the wireless communication devices, the associated base stations and/or associated access points communicate with each other directly, via a system controller, via the public switch telephone network, via the Internet, and/or via some other wide area network.

For each RF wireless communication device to participate in wireless communications, it includes a built-in radio transceiver (i.e., receiver and transmitter) or is coupled to an associated radio transceiver (e.g., a station for in-home and/or in-building wireless communication networks, RF modem, etc.). As is known, the receiver is coupled to the antenna and includes a low noise amplifier, one or more intermediate frequency stages, a filtering stage, and a data recovery stage. The low noise amplifier receives inbound RF signals via the antenna and amplifies then. The one or more intermediate frequency stages mix the amplified RF signals with one or more local oscillations to convert the amplified RF signal into baseband signals or intermediate frequency (IF) signals. The filtering stage filters the baseband signals or the IF signals to attenuate unwanted out of band signals to produce filtered signals. The data recovery stage recovers raw data from the filtered signals in accordance with the particular wireless communication standard.

As is also known, the transmitter includes a data modulation stage, one or more intermediate frequency stages, and a power amplifier. The data modulation stage converts raw data into baseband signals in accordance with a particular wireless communication standard. The one or more intermediate frequency stages mix the baseband signals with one or more local oscillations to produce RF signals. The power amplifier amplifies the RF signals prior to transmission via an antenna.

Since the wireless part of a wireless communication begins and ends with the antenna, a properly designed antenna structure is an important component of wireless communication devices. As is known, the antenna structure is designed to have a desired impedance (e.g., 50 Ohms) at an operating frequency, a desired bandwidth centered at the desired operating frequency, and a desired length (e.g., ¼ wavelength of the operating frequency for a monopole antenna). As is further known, the antenna structure may include a single monopole or dipole antenna, a diversity antenna structure, the same polarization, different polarization, and/or any number of other electro-magnetic properties.

One popular antenna structure for RF transceivers is a three-dimensional in-air helix antenna, which resembles an expanded spring. The in-air helix antenna provides a magnetic omni-directional monopole antenna. Other types of three-dimensional antennas include aperture antennas of a rectangular shape, horn shaped, etc,; three-dimensional dipole antennas having a conical shape, a cylinder shape, an elliptical shape, etc.; and reflector antennas having a plane reflector, a corner reflector, or a parabolic reflector. An issue with such three-dimensional antennas is that they cannot be implemented in the substantially two-dimensional space of a substrate such as an integrated circuit (IC) and/or on the printed circuit board (PCB) supporting the IC.

Two-dimensional antennas are known to include a meandering pattern or a micro strip configuration. For efficient antenna operation, the length of an antenna should be ¼ wavelength for a monopole antenna and ½ wavelength for a dipole antenna, where the wavelength ($\lambda$)=c/f, where c is the speed of light and f is frequency. For example, a ¼ wavelength antenna at 900 MHz has a total length of approximately 8.3 centimeters (i.e., $0.25*(3\times10^8$ m/s)/$(900\times10^6$ c/s)=0.25*33 cm, where m/s is meters per second and c/s is cycles per second). As another example, a ¼ wavelength antenna at 2400 MHz has a total length of approximately 3.1 cm (i.e., $0.25*(3\times10^8$ m/s)/$(2.4\times10^9$ c/s)=0.25*12.5 cm).

Regardless of whether a two-dimensional antenna is implemented on an IC and/or a PCB, the amount of area that it consumes is an issue. For example, a dipole antenna that uses Hilbert shapes operating in the 5.5 GHz frequency band requires each antenna element to be ¼ wavelength, which is 13.6 mm ["Compact 2D Hilbert Microstrip Resonators," MICROWAVE AND OPTICAL TECHNOLOGY LETTERS, Vol. 48, No. 2, February 2006]. Each antenna element consumes approximately 3.633 $mm^2$ (e.g., ½*(1.875 mm×3.875 mm)), which has a length-to-area ratio of 3.74:1 (e.g., 13.6:3.633). While this provides a relatively compact two-dimensional antenna, further reductions in consumed area are needed with little or no degradation in performance.

BRIEF SUMMARY OF THE INVENTION

The present invention is directed to apparatus and methods of operation that are further described in the following Brief Description of the Drawings, the Detailed Description of the Invention, and the claims. Other features and advantages of the present invention will become apparent from the following detailed description of the invention made with reference to the accompanying drawings.

BRIEF DESCRIPTION OF THE SEVERAL VIEWS OF THE DRAWING(S)

Figures 9A, 9B, 9C:
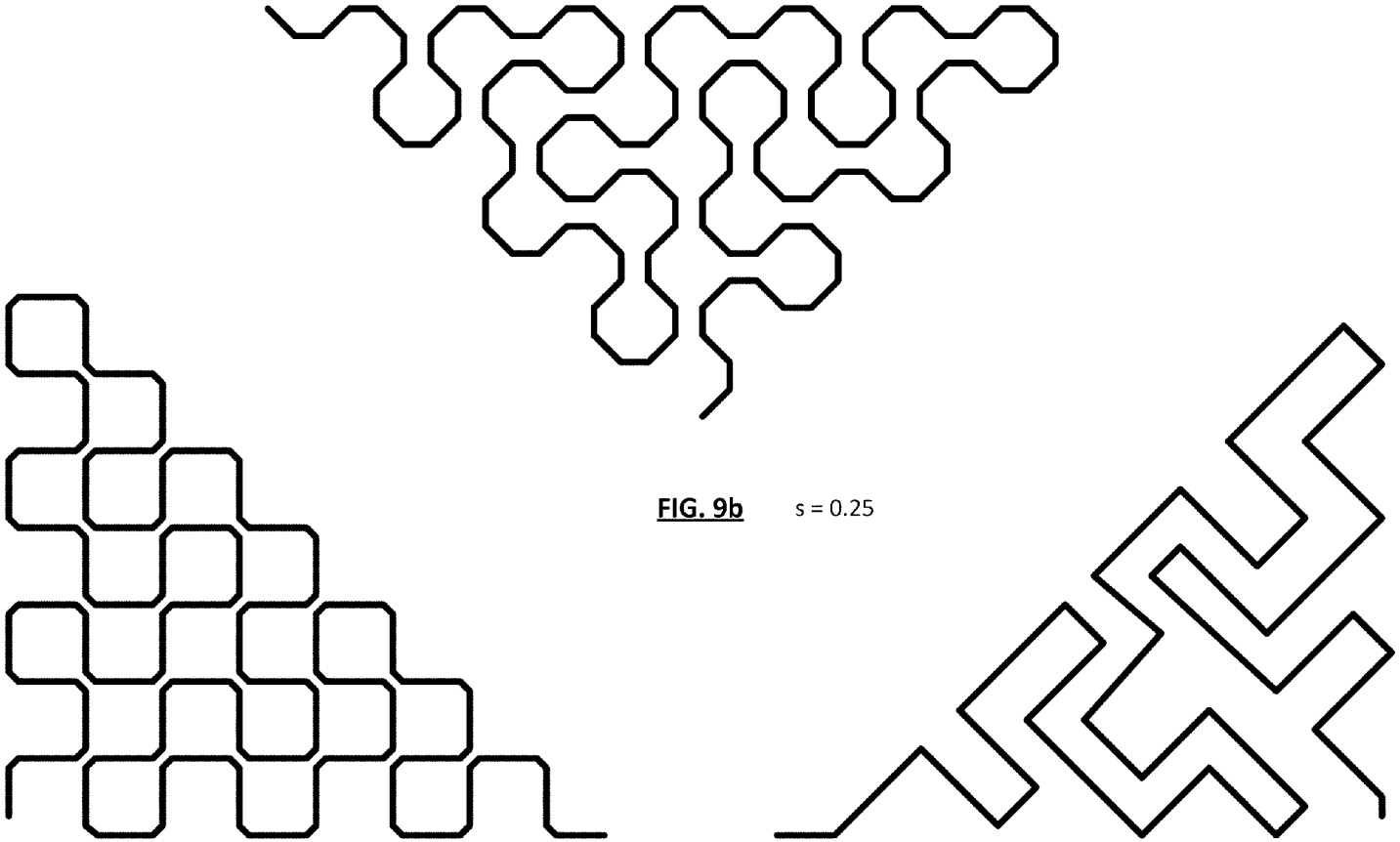
Figure 12:
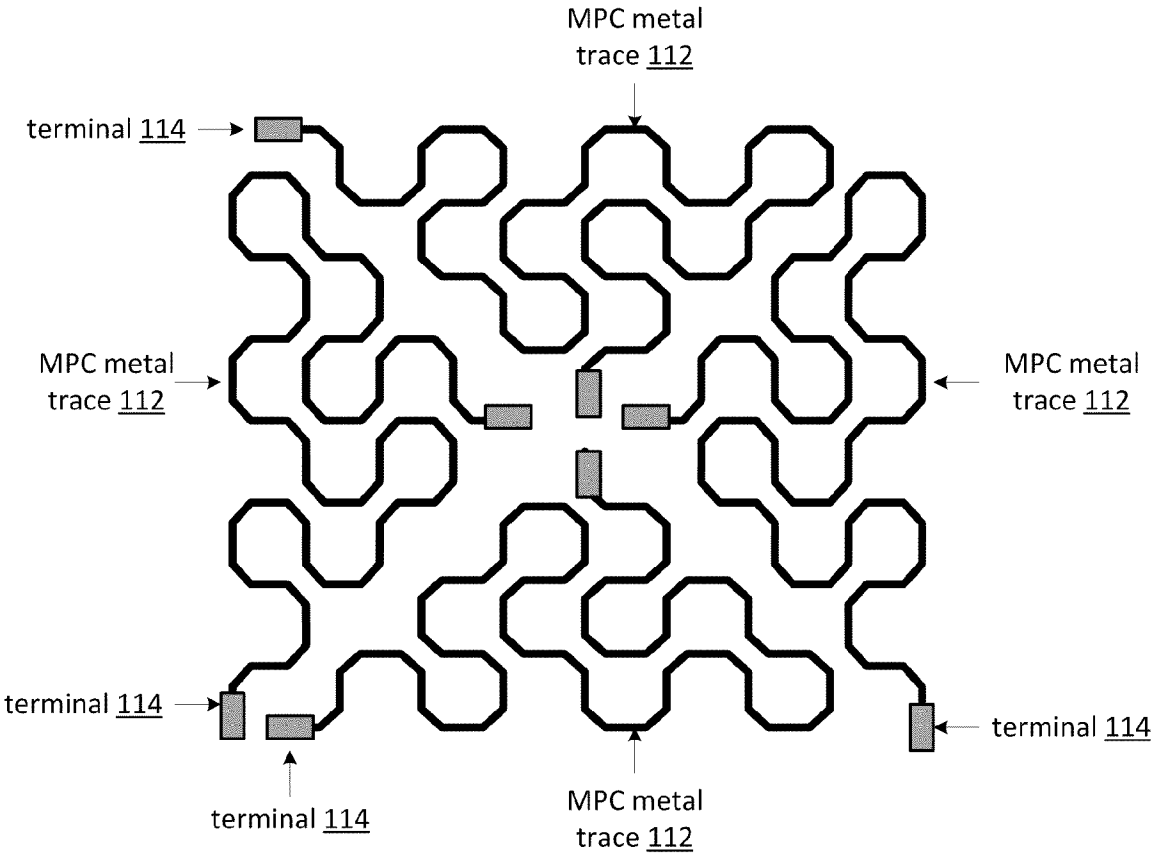
Figure 13:
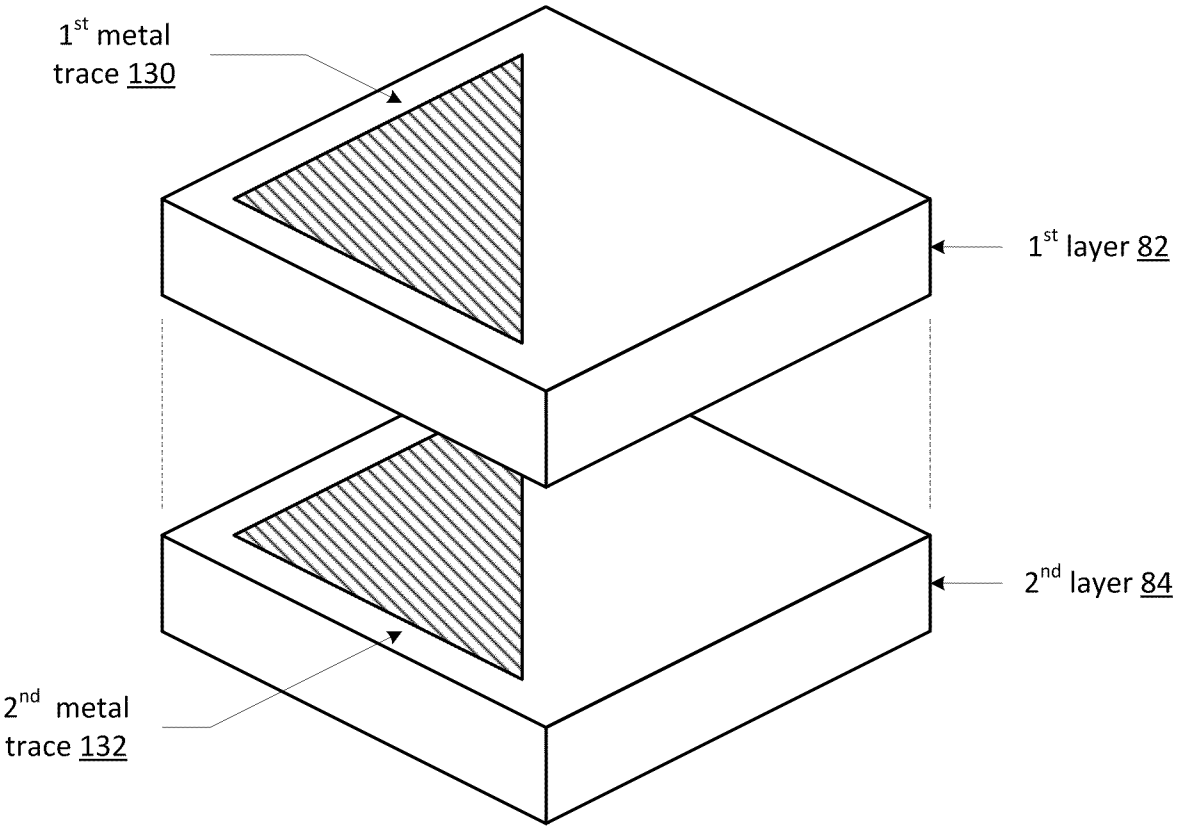
Figure 14:
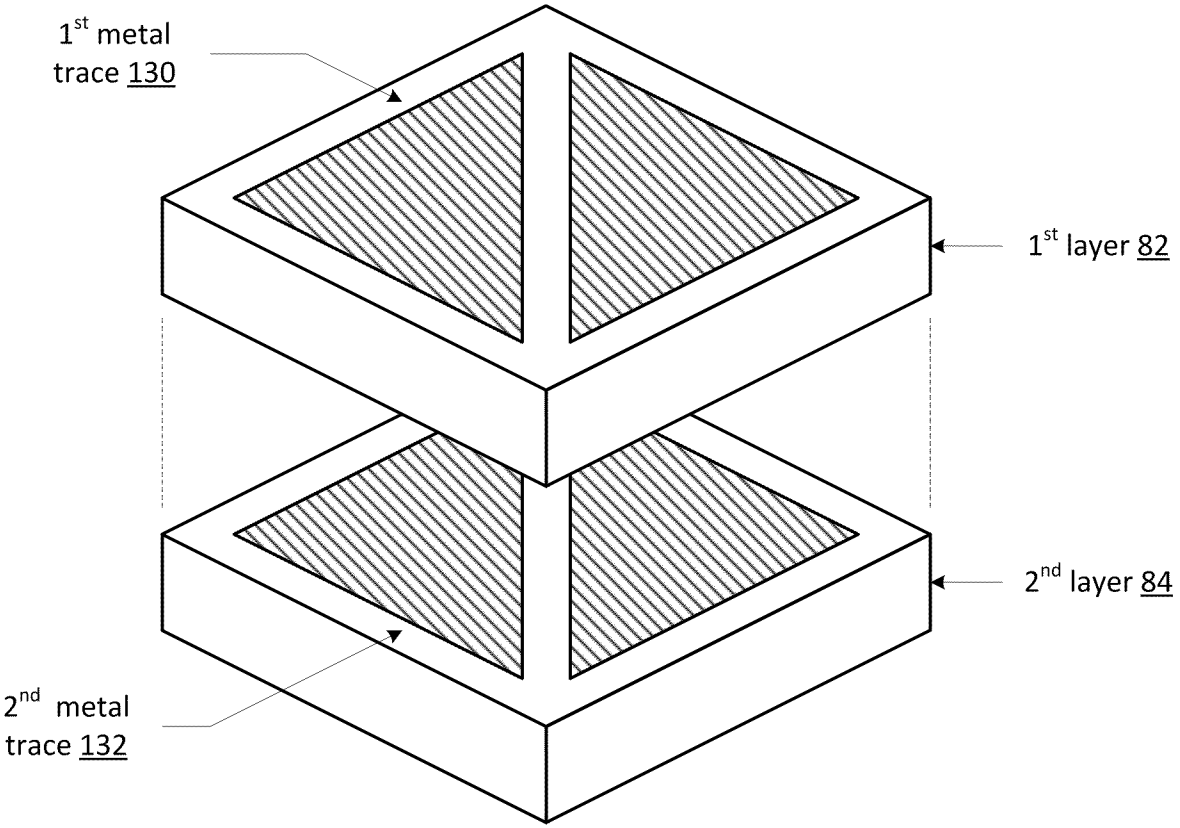
Figure 16:
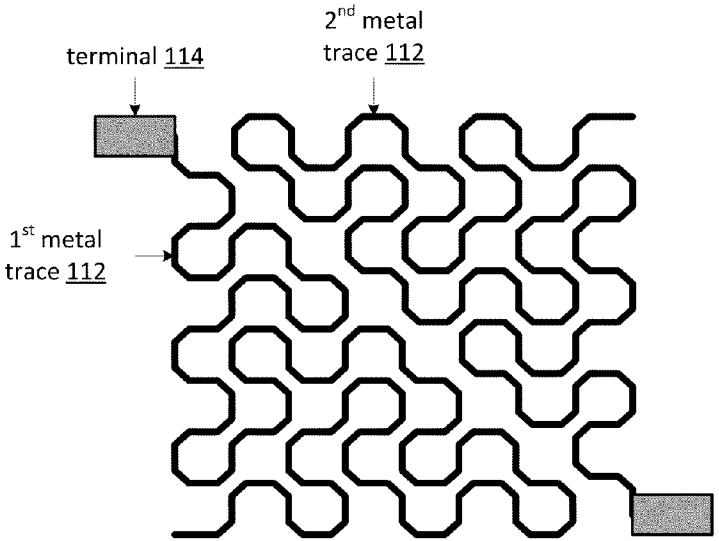
Figure 15:
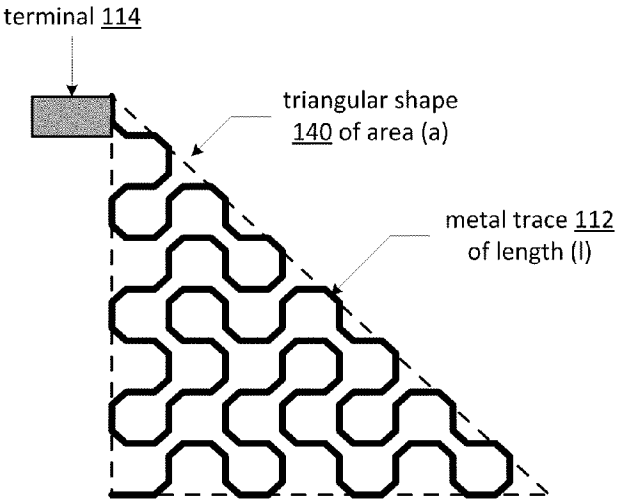
Figure 17:
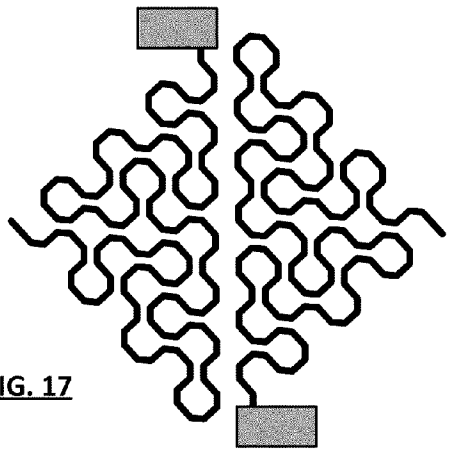

FIGS. 8*a*-8*e* are diagrams of embodiments of a metal trace in accordance with the present invention;

FIGS. 9*a*-9*c* are diagrams of embodiments of a metal trace in accordance with the present invention;

FIGS. 10*a* and 10*b* are diagrams of embodiments of a metal trace in accordance with the present invention;

FIGS. 11*a*-11*h* are diagrams of embodiments of a polygonal shape in accordance with the present invention;

FIG. 12 is a diagram of another embodiment of an antenna structure in accordance with the present invention;

FIG. 13 is a diagram of another embodiment of an antenna apparatus in accordance with the present invention;

FIG. 14 is a diagram of another embodiment of an antenna apparatus in accordance with the present invention;

FIG. 15 is a diagram of another embodiment of an antenna apparatus in accordance with the present invention;

FIG. 16 is a diagram of another embodiment of an antenna apparatus in accordance with the present invention;

FIG. 17 is a diagram of another embodiment of an antenna apparatus in accordance with the present invention.

DETAILED DESCRIPTION OF THE INVENTION

Figure 1:
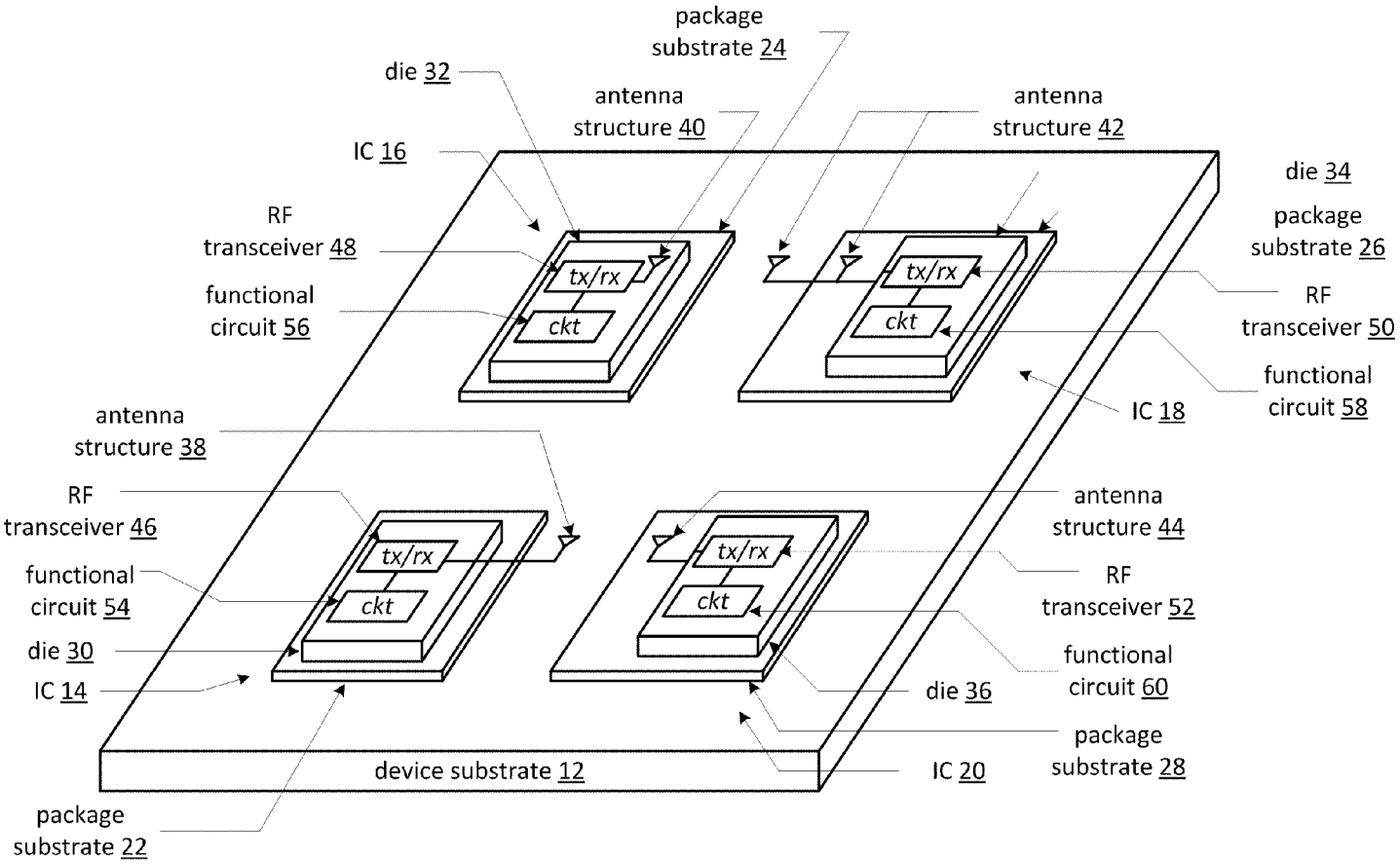
FIG. 1 is a diagram of an embodiment of a device in accordance with the present invention.

FIG. 1 is a diagram of an embodiment of a device 10 that includes a device substrate 12 and a plurality of integrated circuits (IC) 14-20. Each of the ICs 14-20 includes a package substrate 22-28 and a die 30-36. Die 30 of IC 14 includes a functional circuit 54 and a radio frequency (RF) transceiver 46 coupled to an antenna structure 38 on the substrate 12. Die 32 of IC 16 includes an antenna structure 40, an RF transceiver 48, and a functional circuit 56. Die 34 of IC 18 includes an RF transceiver 50 and a function circuit 58 and the package substrate 26 of IC 18 and the substrate 12 supports an antenna structure 42 that is coupled to the RF transceiver 52. Die 36 of IC 20 includes an RF transceiver 52 and a function circuit 60 and the package substrate 28 of IC 20 supports an antenna structure 44 coupled to the RF transceiver 52.

The device 10 may be any type of electronic equipment that includes integrated circuits. For example, but far from an exhaustive list, the device 10 may be a personal computer, a laptop computer, a hand held computer, a wireless local area network (WLAN) access point, a WLAN station, a cellular telephone, an audio entertainment device, a video entertainment device, a video game control and/or console, a radio, a cordless telephone, a cable set top box, a satellite receiver, network infrastructure equipment, a cellular telephone base station, and Bluetooth head set. Accordingly, the functional circuit 54-60 may include one or more of a WLAN baseband processing module, a WLAN RF transceiver, a cellular voice baseband processing module, a cellular voice RF transceiver, a cellular data baseband processing module, a cellular data RF transceiver, a local infrastructure communication (LIC) baseband processing module, a gateway processing module, a router processing module, a game controller circuit, a game console circuit, a microprocessor, a microcontroller, and memory.

In one embodiment, the dies 30-36 may be fabricated using complimentary metal oxide (CMOS) technology and the package substrate may be a printed circuit board (PCB). In other embodiments, the dies 30-36 may be fabricated using Gallium-Arsenide technology, Silicon-Germanium technology, bi-polar, bi-CMOS, and/or any other type of IC fabrication technique. In such embodiments, the package substrate 22-28 may be a printed circuit board (PCB), a fiberglass board, a plastic board, and/or some other non-conductive material board. Note that if the antenna structure is on the die, the package substrate may simply function as a supporting structure for the die and contain little or no traces.

In an embodiment, the RF transceivers 46-52 provide local wireless communication (e.g., IC to IC communication) and/or remote wireless communications (e.g., to/from the device to another device). In this embodiment, when a functional circuit of one IC has information (e.g., data, operational instructions, files, etc.) to communication to another functional circuit of another IC or to another device, the RF transceiver of the first IC conveys the information via a wireless path to the RF transceiver of the second IC or to the other device. In this manner, some to all of the IC-to-IC communications may be done wirelessly.

In one embodiment, a baseband processing module of the first IC converts outbound data (e.g., data, operational instructions, files, etc.) into an outbound symbol stream. The conversion of outbound data into an outbound symbol stream may be done in accordance with one or more data modulation schemes, such as amplitude modulation (AM), frequency modulation (FM), phase modulation (PM), amplitude shift keying (ASK), phase shift keying (PSK), quadrature PSK (QPSK), 8-PSK, frequency shift keying (FSK), minimum shift keying (MSK), Gaussian MSK (GMSK), quadrature amplitude modulation (QAM), a combination thereof, and/or alterations thereof. For example, the conversion of the outbound data into the outbound system stream may include one or more of scrambling, encoding, puncturing, interleaving, constellation mapping, modulation, frequency to time domain conversion, space-time block encoding, space-frequency block encoding, beamforming, and digital baseband to IF conversion.

The RF transceiver of the first IC converts the outbound symbol stream into an outbound RF signal. The antenna structure of the first IC is coupled to the RF transceiver and transmits the outbound RF signal, which has a carrier frequency within a frequency band (e.g., 900 MHz, 1800 MHz, 1900 MHz, 2.4 GHz, 5.5. GHz, 55 GHz to 64 GHz, etc.). Accordingly, the antenna structure includes electromagnetic properties to operate within the frequency band. For example, the length of the antenna structure may be ¼ or ½ wavelength, have a desired bandwidth, have a desired impedance, have a desired gain, etc.

For a local wireless communication, the antenna structure of the second IC receives the RF signal as an inbound RF signal and provides it to the RF transceiver of the second IC. The RF transceiver converts the inbound RF signal into an inbound symbol stream and provides the inbound symbol stream to a baseband processing module of the second IC. The baseband processing module of the second IC converts the inbound symbol stream into inbound data in accordance with one or more data modulation schemes, such as amplitude modulation (AM), frequency modulation (FM), phase modulation (PM), amplitude shift keying (ASK), phase shift keying (PSK), quadrature PSK (QSK), 8-PSK, frequency shift keying (FSK), minimum shift keying (MSK), Gaussian MSK (GMSK), quadrature amplitude modulation (QAM), a combination thereof, and/or alterations thereof. For example, the conversion of the inbound system stream into the inbound data may include one or more of descrambling, decoding, depuncturing, deinterleaving, constellation demapping, demodulation, time to frequency domain conversion, space-time block decoding, space-frequency block decoding, debeamforming, and IF to digital baseband conversion. Note that the baseband processing modules of the first and second ICs may be on same die as RF transceivers or on a different die within the respective IC.

In other embodiments, each IC 14-20 may include a plurality of RF transceivers and antenna structures on-die, on-package substrate, and/or on the substrate 12 to support multiple simultaneous RF communications using one or more of frequency offset, phase offset, wave-guides (e.g., use waveguides to contain a majority of the RF energy), frequency reuse patterns, frequency division multiplexing, time division multiplexing, null-peak multiple path fading (e.g., ICs in nulls to attenuate signal strength and ICs in peaks to accentuate signal strength), frequency hopping, spread spectrum, space-time offsets, and space-frequency offsets. Note that the device 10 is shown to only include four ICs 14-20 for ease of illustrate, but may include more or less that four ICs in practical implementations.

Figure 2:
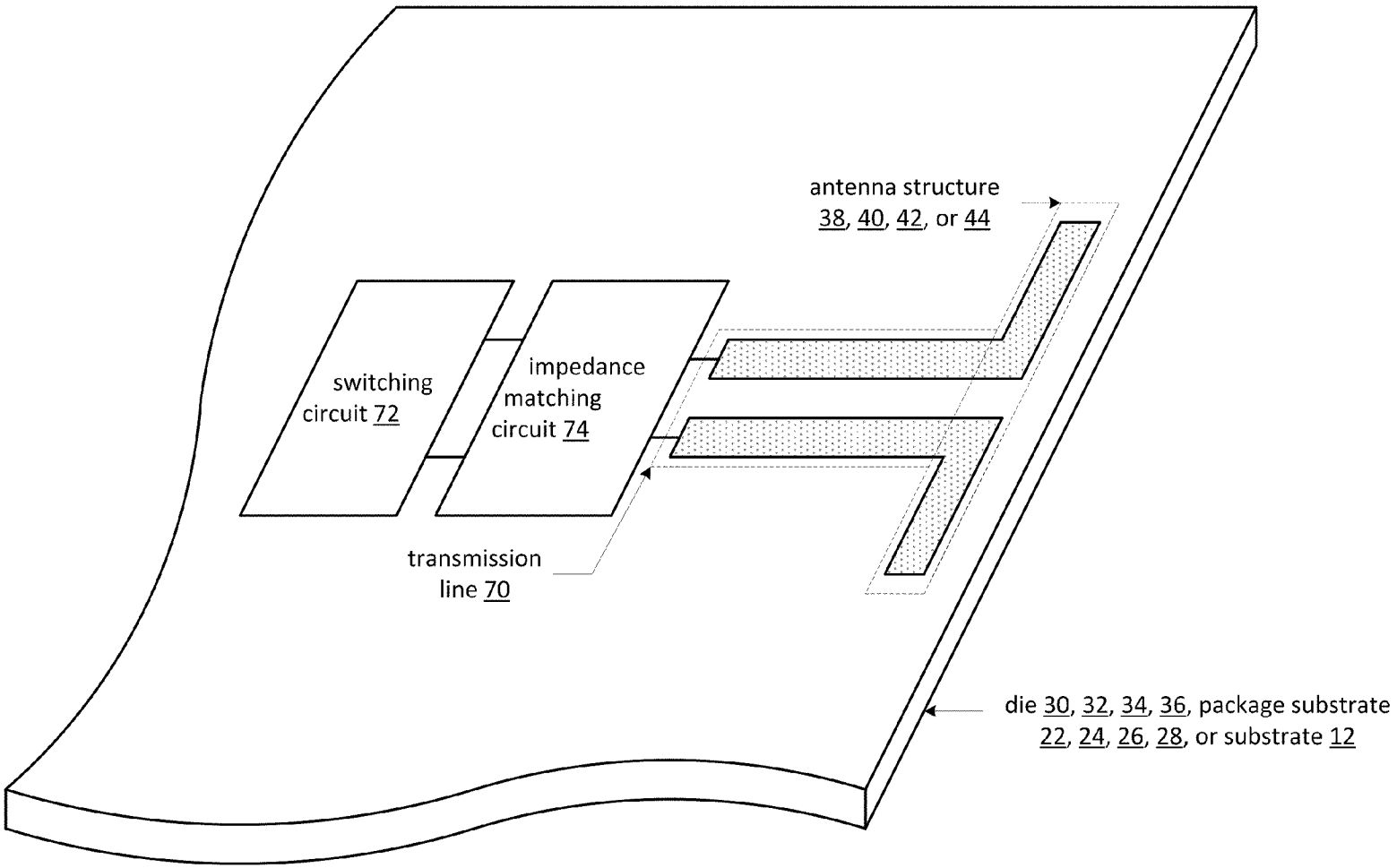
FIG. 2 is a diagram of an embodiment of an antenna apparatus in accordance with the present invention.

FIG. 2 is a diagram of an embodiment of an antenna structure 38-44 on a die 30-36, a package substrate 22-28, and/or the substrate 12. The antenna structure 38-44 is coupled to a transmission line 70, which may be coupled to an impedance matching circuit 74 and a switching circuit 72. The antenna structure 38-40 may be one or more metal traces on the die, the package substrate, and/or the substrate 12 to provide a half-wavelength dipole antenna, a quarter-wavelength monopole antenna, an antenna array, a multiple input multiple output (MIMO) antenna, and/or a microstrip patch antenna.

The transmission line 70, which may be a pair of microstrip lines on the die, the package substrate, and/or on the device substrate (individually, collectively or in combination may provide the substrate for the antenna apparatus), is electrically coupled to the antenna structure 38-44 and electromagnetically coupled to the impedance matching circuit 74 by first and second conductors. In one embodiment, the electromagnetic coupling of the first conductor to a first line of the transmission line 70 produces a first transformer and the electromagnetic coupling of the second conductor to a second line of the transmission line produces a second transformer.

The impedance matching circuit 74, which may include one or more of an adjustable inductor circuit, an adjustable capacitor circuit, an adjustable resistor circuit, an inductor, a capacitor, and a resistor, in combination with the transmission line 70 and the first and second transformers establish the impedance for matching that of the antenna structure 38-44.

The switching circuit 72 includes one or more switches, transistors, tri-state buffers, and tri-state drivers, to couple the impedance matching circuit 74 to the RF transceiver 46-52. In one embodiment, the switching circuit 72 receives a coupling signal from the RF transceiver 46-52, a control module, and/or a baseband processing module, wherein the coupling signal indicates whether the switching circuit 72 is open (i.e., the impedance matching circuit 74 is not coupled to the RF transceiver 46-52) or closed (i.e., the impedance matching circuit 74 is coupled to the RF transceiver 46-52).

Figure 3:
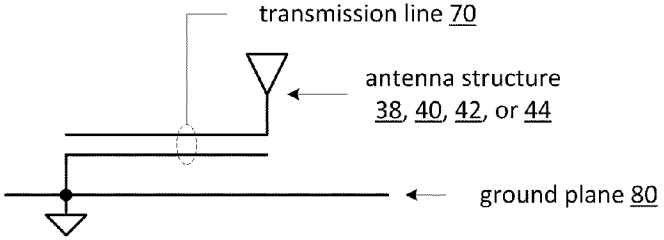
FIG. 3 is a schematic block diagram of an embodiment of antenna in accordance with the present invention.

FIG. 3 is a schematic diagram of an antenna structure 38-44 coupled to the transmission line 70 and a ground plane 80. The antenna structure 28-44 may be a half-wavelength dipole antenna or a quarter-wavelength monopole antenna that includes a trace having a modified Polya curve shape that is confined to a triangular shape. The transmission line 70 includes a first line and a second line, which are substantially parallel. In one embodiment, at least the first line of the transmission line 70 is electrically coupled to the antenna structure 38-44.

The ground plane 80 has a surface area larger than the surface area of the antenna structure 38-44. The ground plane 80, from a first axial perspective, is substantially parallel to the antenna structure 38-44 and, from a second axial perspective, is substantially co-located to the antenna structure 38-44.

Figure 4:
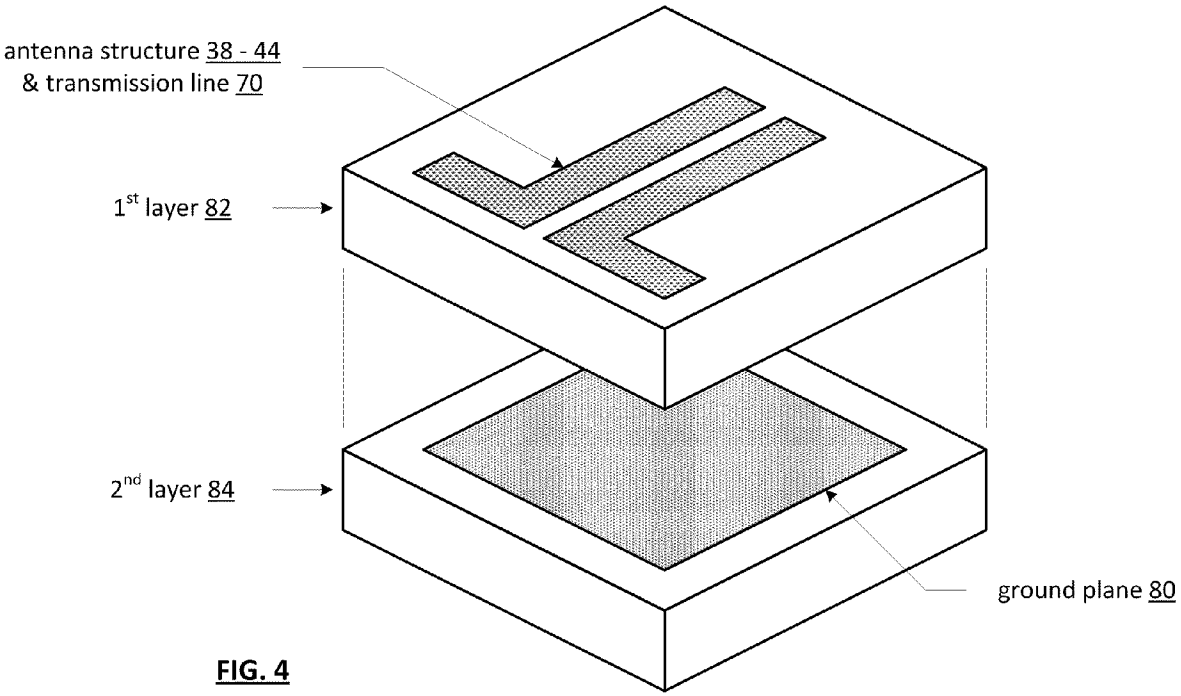
FIG. 4 is a diagram of another embodiment of an antenna apparatus in accordance with the present invention.

FIG. 4 is a diagram of an embodiment of an antenna structure 38-44 on a die 30-36, a package substrate 22-28, and/or the device substrate 12. The antenna structure 38-44 includes one or more antenna elements, the antenna ground plane 80, and the transmission line 70. In this embodiment, the one or more antenna elements and the transmission line 70 are on a first layer 82 of the die, the package substrate, and/or the device substrate 12, and the ground plane 80 is on a second layer 84 of the die, the package substrate, and/or the device substrate 12.

Figure 5:
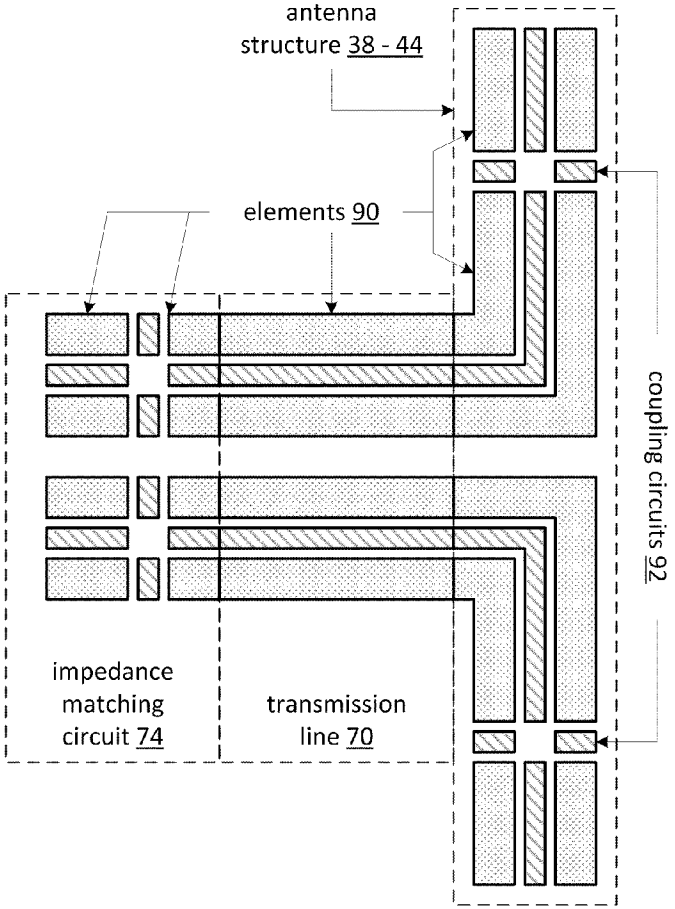
FIG. 5 is a diagram of another embodiment of an antenna apparatus in accordance with the present invention.

FIG. 5 is a diagram of an embodiment of an antenna structure 38-44 coupled to the transmission line 70, which is coupled to the impedance matching circuit 74. In this illustration, the antenna structure 38-44, the transmission line 70, and the impedance matching circuit 74 includes a plurality of elements 90 and coupling circuits 92. The coupling circuits 92 allow the elements 90 to be configured to provide antenna structure with desired antenna properties. For example, the antenna structure may have a different desired effective length, a different desired bandwidth, a different desired impedance, a different desired quality factor, and/or a different desired frequency band.

As a specific example, the bandwidth of an antenna having a length of ½ wavelength or less is primarily dictated by the antenna's quality factor (Q), which may be mathematically expressed as shown in Eq. 1 where $v_0$ is the resonant frequency, 2 δ v is the difference in frequency between the two half-power points (i.e., the bandwidth).

$$\frac{v_0}{2\partial v} = \frac{1}{Q} \quad \text{Equation 1}$$

Equation 2 provides a basic quality factor equation for the antenna structure, where R is the resistance of the antenna structure, L is the inductance of the antenna structure, and C is the capacitor of the antenna structure.

$$Q = \frac{1}{R} * \sqrt{\frac{L}{C}} \quad \text{Equation 2}$$

As such, by adjusting the resistance, inductance, and/or capacitance of an antenna structure, the bandwidth can be controlled. For instance, the smaller the quality factor, the narrower the bandwidth. Note that the capacitance is primarily established by the length of, and the distance between, the lines of the transmission line 70, the distance between the elements of the antenna 90, and any added capacitance to the antenna structure. Further note that the lines of the transmission line 70 and those of the antenna structure 38-44 may be on the same layer of an IC, package substrate, and/or the device substrate 12 and/or on different layers.

Figure 6:
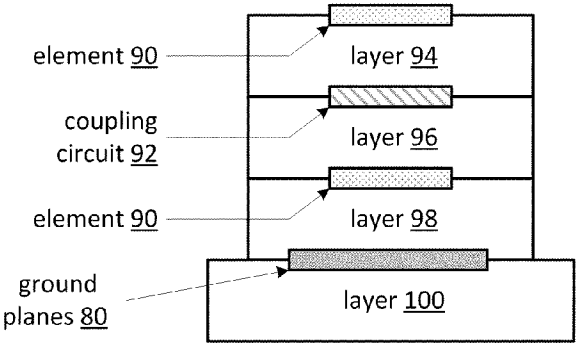
FIG. 6 is a diagram of another embodiment of an antenna apparatus in accordance with the present invention.

FIG. 6 is a diagram of an embodiment of an antenna structure 38-44 that includes the elements 90 on layers 94 and 98 of the substrate (e.g., the die, the package substrate, and/or the device substrate) and the coupling circuits 92 on layer 96. If a ground plane 80 is included, it may be on another layer 100 of the substrate.

In this embodiment, with the elements 90 on different layers, the electromagnetic coupling between them via the coupling circuits 92 is different than when the elements are on the same layer as shown in FIG. 5. Accordingly, a different desired effective length, a different desired bandwidth, a different desired impedance, a different desired quality factor, and/or a different desired frequency band may be obtained.

In an embodiment of this illustration, the adjustable ground plane 80 may include a plurality of ground planes and a ground plane selection circuit. The plurality of ground planes is on one or more layers of the substrate.

In an embodiment of this illustration, the adjustable ground plane 572 includes a plurality of ground plane elements and a ground plane coupling circuit. The ground plane coupling circuit is operable to couple at least one of the plurality of ground plane elements into the ground plane in accordance with a ground plane characteristic signal, which may be provided by one or more of the functional circuits.

Figure 7:
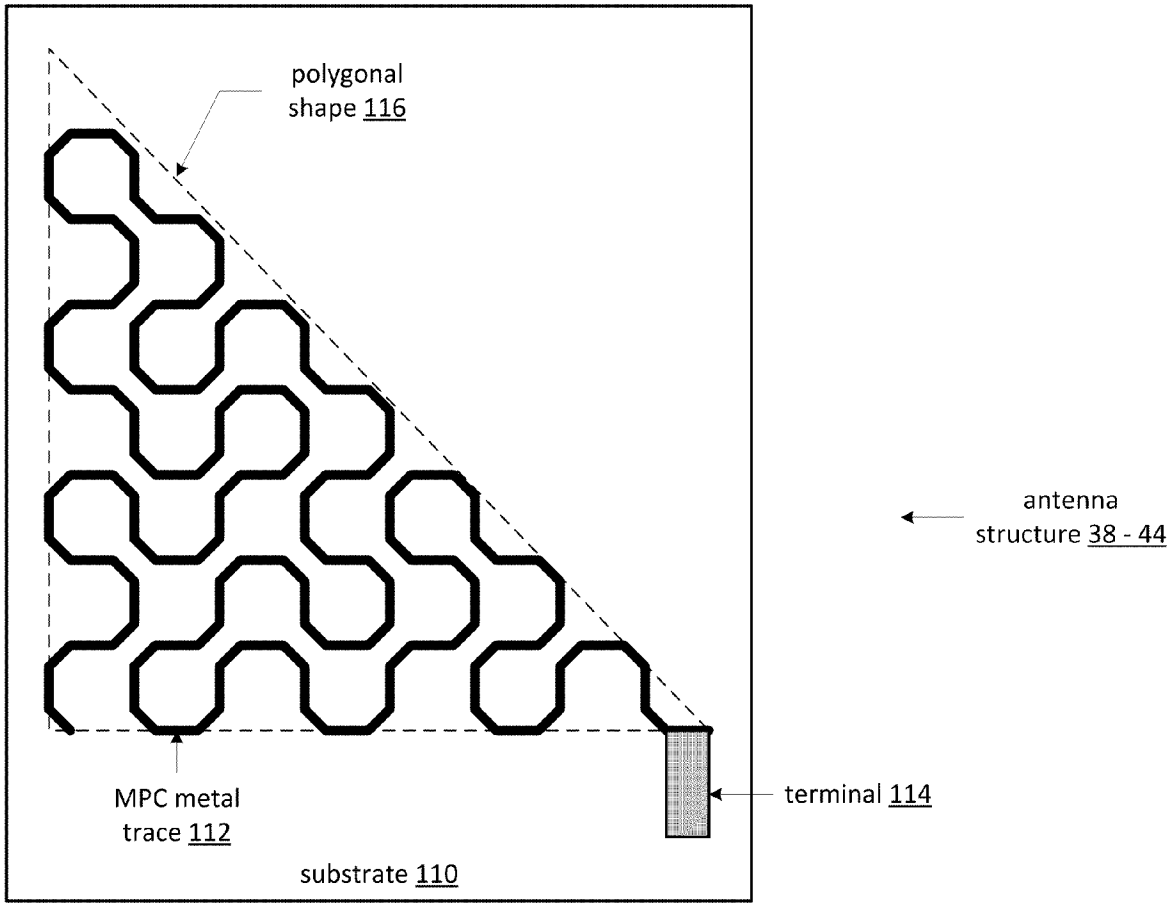
FIG. 7 is a diagram of an embodiment of an antenna structure in accordance with the present invention.

FIG. 7 is a diagram of an embodiment of an antenna structure 38-44 that includes a modified Polya curve (MPC) metal trace 112 and a terminal 114 coupled thereto. The MPC metal trace 112 is confined to a polygonal shape 116 and has an order (e.g., n=>2 examples are shown in FIGS. 8*a*-8*e*), line width (e.g., trace width), and/or a shaping factor (e.g., s<1 examples are show in FIGS. 9*a*-9*c*). The antenna structure is supported by a substrate 110 (which may be an IC die, a IC package substrate, and/or a device substrate).

The MPC metal trace 112 may be configured to provide one or more of a variety of antenna configurations. For example, the MPC metal trace 112 may have a length of ¼ wavelength to provide a monopole antenna. As another example, the MPC metal trace 112 may be configured to provide a dipole antenna. In this example, the MPC metal trace 112 would include two sections, each ¼ wavelength in length. As yet another example, the MPC metal trace 112 may be configure to provide a microstrip patch antenna.

Figure 8A:
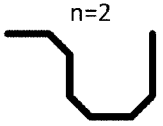
Figure 8B:
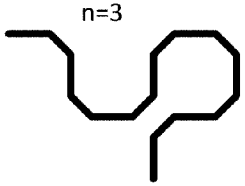
Figure 8C:
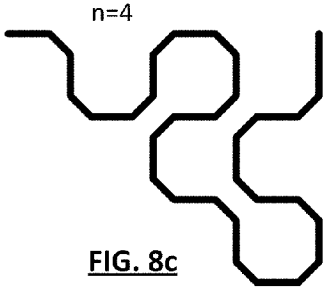
Figure 8D:
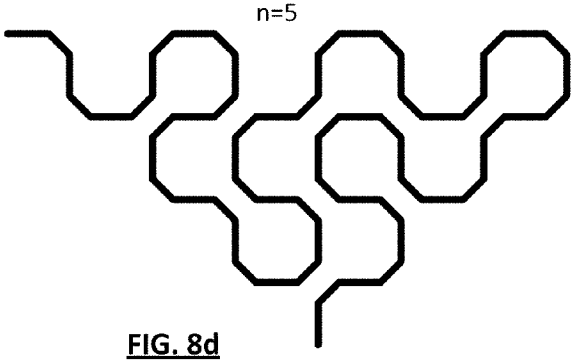
Figure 8E:
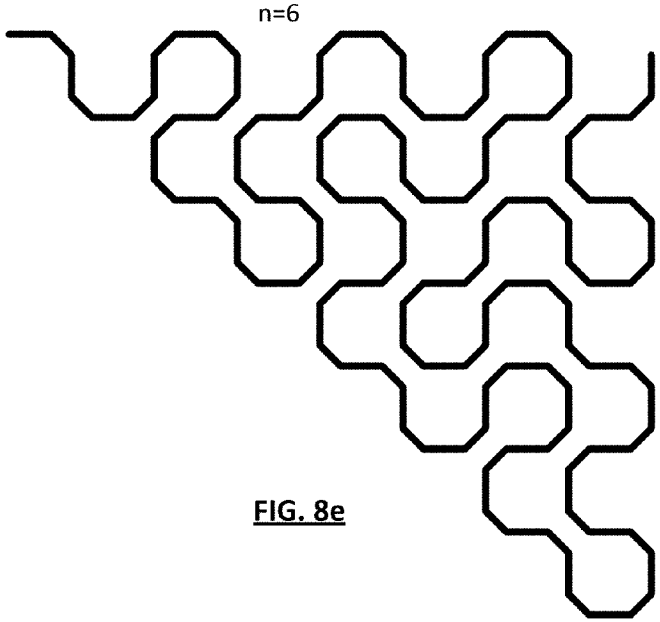

FIGS. 8*a*-8*e* are diagrams of embodiments of an MPC (modified Polya curve) metal trace having a constant width (w) and shaping factor (s) and varying order (n). In particular, FIG. 8*a* illustrates a MPC metal trace having a second order; FIG. 8*b* illustrates a MPC metal trace having a third order; FIG. 8*c* illustrates a MPC metal trace having a fourth order; FIG. 8*d* illustrates a MPC metal trace having a fifth order; and FIG. 8*e* illustrates a MPC metal trace having a sixth order. Note that higher order MPC metal traces may be used within the polygonal shape to provide the antenna structure.

FIGS. 9*a*-9*c* are diagrams of embodiments of an MPC (modified Polya curve) metal trace having a constant width (w) and order (n) and a varying shaping factor (s). In particular, FIG. 9*a* illustrates a MPC metal trace having a 0.15 shaping factor; FIG. 9*b* illustrates a MPC metal trace having a 0.25 shaping factor; and FIG. 9*c* illustrates a MPC metal trace having a 0.5 shaping factor. Note that MPC metal trace may have other shaping factors to provide the antenna structure.

FIGS. 10*a* and 10*b* are diagrams of embodiments of an MPC (modified Polya curve) metal trace. In FIG. 10*a*, the MPC metal trace is confined in an orthogonal triangle shape and includes two elements: the shorter angular straight line and the curved line. In this implementation, the antenna structure is operable in two or more frequency bands. For example, the antenna structure may be operable in the 2.4 GHz frequency band and the 5.5 GHz frequency band.

FIG. 10*b* illustrates an optimization of the antenna structure of FIG. 10*a*. In this diagram, the straight line trace includes an extension metal trace 120 and the curved line is shortened. In particular, the extension trace 120 and/or the shortening of the curved trace tune the properties of the antenna structure (e.g., frequency band, bandwidth, gain, etc.).

FIGS. 11*a*-11*h* are diagrams of embodiments of polygonal shapes in which the modified Polya curve (MPC) trace may be confined. In particular, FIG. 11*a* illustrates an Isosceles triangle; FIG. 11*b* illustrates an equilateral triangle; FIG. 11*c* illustrates an orthogonal triangle; FIG. 11*d* illustrates an arbitrary triangle; FIG. 11*e* illustrates a rectangle; FIG. 11*f* illustrates a pentagon; FIG. 11*g* illustrates a hexagon; and FIG. 11*h* illustrates an octagon. Note that other geometric shapes may be used to confine the MPC metal trace. For example, a circle, an ellipse, etc.

FIG. 12 is a diagram of another embodiment of an antenna structure 38-44 that includes a plurality of metal traces 112 and a plurality of terminals 114. The plurality of metal traces 112 are confined within the polygonal shape (a rectangle in this example, but could be a triangle, a pentagon, a hexagon, an octagon, etc.) and each of the metal traces 112 has the modified Polya curve shape. The plurality of terminals 114 are coupled to the plurality of metal traces 112.

In this embodiment, the plurality of metal traces may be coupled to form an antenna array; may be coupled to form a multiple input multiple output (MIMO) antenna; may be coupled to form a microstrip patch antenna; may be coupled to form a dipole antenna; or may be coupled to form a monopole antenna.

FIG. 13 is a diagram of another embodiment of an antenna apparatus that includes a substrate (e.g., a die, an IC package substrate, and/or a device substrate) and an antenna structure, which includes a first metal trace 130 and a second metal trance 132. The substrate includes a plurality of layers 82-84. Note that the layers may be of the same substrate element (e.g., the die, the IC package substrate, or the device substrate) or of different substrate elements (e.g., one or more layers of the IC package substrate, one or more layers from the device substrate, one or more layers of the die).

The first metal trace 130 has a first modified Polya curve shape (e.g., has a first order value, a first shaping factor value, and a first line width or trace width value) that is confined in a first polygonal shape (e.g., a triangular shape, a rectangle, a pentagon, hexagon, an octagon, etc.). As shown, the first metal trace 130 is on a first layer 82 of the substrate. While not specifically shown in this illustration, a first terminal is coupled to the first metal trace. Examples of such a configuration are provided in previous figures.

The second metal trace 132 has a second modified Polya curve shape (e.g., has a second order value, a second shaping factor value, and a second line width or trace width value) that is confined in a second polygonal shape (e.g., a triangular shape, a rectangle, a pentagon, hexagon, an octagon, etc.). As is also shown, the second metal trace 132 is on the second layer 84 of the substrate. Note that the first and second modified Polya curves may be the same (e.g., have the same order, shaping factor, and trace width) or different modified Polya curves (e.g., have one or differences in the order, shaping factor, and/or trace width). Further note that a second terminal is coupled to the second metal trace 132.

In an embodiment, the first and second metals trace may be configured to provide a microstrip patch antenna; a dipole antenna; or a monopole antenna. In another embodiment, the first metal trace may be configured to provide a first microstrip patch antenna and the second metal trace may be configured to provide a second microstrip patch antenna. In another embodiment, the first metal trace may be configured to provide a dipole antenna and the second metal trace may be configured to provide a second dipole antenna. In another embodiment, the first metal trace may be configured to provide a first monopole antenna and the second metal trace configured to provide a second monopole antenna. In one or more of the embodiments, the first and/or second metal trace may include an extension metal trace to tune antenna properties of the antenna structure.

FIG. 14 is a diagram of further embodiment of the antenna apparatus of FIG. 13. In this embodiment, the first and/or second metal traces includes a plurality of metal trace segments confined within at least one of the first and second polygonal shapes. Each of the plurality of metal trace segments has at least one of the first and second modified Polya curve shapes and is coupled to a corresponding one of a plurality of terminals.

In an embodiment, the plurality of metal trace segments of the first and/or second metal traces may be coupled to form one or more antenna arrays. In another embodiment, the plurality of metal trace segments of the first and/or second metal traces may be coupled to form one or more multiple input multiple output (MIMO) antennas. In another embodiment, the plurality of metal trace segments of the first and/or second metal traces may be coupled to form one or more microstrip patch antennas. In another embodiment, the plurality of metal trace segments of the first and/or second metal traces may be coupled to form one or more dipole antennas. In another embodiment, the plurality of metal trace segments of the first and/or second metal traces may be coupled to form one or more monopole antennas.

FIG. 15 is a diagram of another embodiment of an antenna apparatus that includes a metal trace 112 of length (l) having a modified Polya curve shape that is confined in a triangular shape 140 of area (a). The length of the metal trace 112 is approximately 4 to 7 times the area of the triangular shape (e.g., Isosceles, equilateral, orthogonal, or arbitrary). In other words, the metal trace has a length-to-area ratio of approximately 4-to-1 to 7-to-1. In comparison to the Hilbert shaped antennas, which has a length-to-area ratio of 3.74:1, the antenna apparatus including a modified Polya curve shape is at least 30% smaller in area. Note that the metal trace 112 is coupled to a terminal 114.

The properties of the antenna apparatus (e.g., center frequency, bandwidth, gain, quality factor, etc.) may be tuned by having an extension metal trace coupled to the metal trace 112. The properties may be further tuned based on the order, the line width, and/or the shaping factor of the modified Polya curve.

In another embodiment, the antenna apparatus includes a plurality of metal traces 112; each having the modified Polya curve shape that is confined in the triangular shape and a length-to-area ratio that is approximately in the range of 4-to-1 to 7-to-1. In this embodiment, the plurality of metal traces are arranged to form a polygonal shape (e.g., a rectangle, a pentagon, a hexagon, an octagon, etc.) to form an antenna array, a MIMO antenna, a microstrip patch antenna, a monopole antenna, or a dipole antenna. Note that the plurality of metal traces is coupled to a plurality of terminals.

FIGS. 16 and 17 are diagrams of dipole antennas having a first and second metal traces 112, each having a modified Polya curve shape confined in a triangular shape and a length-to-area ratio of approximately 4-to-1 to 7-to-1. The first metal trace is juxtaposed to the second metal trace and each are coupled to a terminal 114. In FIG. 16, the metal traces are confined in an orthogonal triangle and in FIG. 17 the metal traces are confined in an equilateral triangle.

As may be used herein, the terms "substantially" and "approximately" provides an industry-accepted tolerance for its corresponding term and/or relativity between items. Such an industry-accepted tolerance ranges from less than one percent to fifty percent and corresponds to, but is not limited to, component values, integrated circuit process variations, temperature variations, rise and fall times, and/or thermal noise. Such relativity between items ranges from a difference of a few percent to magnitude differences. As may also be used herein, the term(s) "operably coupled to", "coupled to", and/or "coupling" includes direct coupling between items and/or indirect coupling between items via an intervening item (e.g., an item includes, but is not limited to, a component, an element, a circuit, and/or a module) where, for indirect coupling, the intervening item does not modify the information of a signal but may adjust its current level, voltage level, and/or power level. As may further be used herein, inferred coupling (i.e., where one element is coupled to another element by inference) includes direct and indirect coupling between two items in the same manner as "coupled to". As may even further be used herein, the term "operable to" or "operably coupled to" indicates that an item includes one or more of power connections, input(s), output(s), etc., to perform, when activated, one or more its corresponding functions and may further include inferred coupling to one or more other items. As may still further be used herein, the term "associated with", includes direct and/or indirect coupling of separate items and/or one item being embedded within another item. As may be used herein, the term "compares favorably", indicates that a comparison between two or more items, signals, etc., provides a desired relationship. For example, when the desired relationship is that signal 1 has a greater magnitude than signal 2, a favorable comparison may be achieved when the magnitude of signal 1 is greater than that of signal 2 or when the magnitude of signal 2 is less than that of signal 1.

The present invention has also been described above with the aid of method steps illustrating the performance of specified functions and relationships thereof. The boundaries and sequence of these functional building blocks and method steps have been arbitrarily defined herein for convenience of description. Alternate boundaries and sequences can be defined so long as the specified functions and relationships are appropriately performed. Any such alternate boundaries or sequences are thus within the scope and spirit of the claimed invention.

The present invention has been described above with the aid of functional building blocks illustrating the performance of certain significant functions. The boundaries of these functional building blocks have been arbitrarily defined for convenience of description. Alternate boundaries could be defined as long as the certain significant functions are appropriately performed. Similarly, flow diagram blocks may also have been arbitrarily defined herein to illustrate certain significant functionality. To the extent used, the flow diagram block boundaries and sequence could have been defined otherwise and still perform the certain significant functionality. Such alternate definitions of both functional building blocks and flow diagram blocks and sequences are thus within the scope and spirit of the claimed invention. One of average skill in the art will also recognize that the functional building blocks, and other illustrative blocks, modules and components herein, can be implemented as illustrated or by discrete components, application specific integrated circuits, processors executing appropriate software and the like or any combination thereof.

What is claimed is:

1. An antenna apparatus comprises:

a substrate; and an antenna structure supported by the substrate, wherein the antenna structure includes:

a metal trace having a modified Polya curve shape that is confined in a polygonalshape; and a terminal coupled to the metal trace.

2. The antenna apparatus of claim 1, wherein the modified Polya curve shape comprises:

an order, a line width, and a shaping factor, wherein at least one of the order, the line width, and the shaping factor is of a value such that the metal trace substantially covers the polygonal shape and provides desired antenna properties.

3. The antenna apparatus of claim 1, wherein the polygonal shape comprises at least one of: an isosceles triangle, an equilateral triangle, an orthogonal triangle, an arbitrary triangle, a rectangle, a pentagon, a hexagon, and an octagon.

4. The antenna apparatus of claim 1, wherein the metal trace comprises:

an extension metal trace to tune antenna properties of the antenna structure.

5. The antenna apparatus of claim 1, wherein the antenna structure comprises at least one of:

the metal trace configured to provide a microstrip patch antenna;

the metal trace configured to provide a dipole antenna; and the metal trace configured to provide a monopole antenna.

6. The antenna apparatus of claim 1, wherein the antenna structure comprises:

a plurality of metal traces confined within the polygonal shape, wherein each of the plurality of metal traces has the modified Polya curve shape; and a plurality of terminals coupled to the plurality of metal traces, wherein the plurality of metal traces includes the metal trace and the plurality of terminals includes the terminal.

7. The antenna apparatus of claim 6 further comprises at least one of:

the plurality of metal traces coupled to form an antenna array;

the plurality of metal traces coupled to form a multiple input multiple output (MIMO) antenna;

the plurality of metal traces coupled to form a microstrip patch antenna;

the plurality of metal traces coupled to form a dipole antenna; and the plurality of metal traces coupled to form a monopole antenna.

8. An antenna apparatus comprises:

a substrate having a plurality of layers;

an antenna structure that includes:

a first metal trace having a first modified Polya curve shape that is confined in a first polygonal shape, wherein the first metal trace is on a first layer of the plurality of layers;

a first terminal coupled to the first metal trace;

a second metal trace having a second modified Polya curve shape that is confined in a second polygonal shape, wherein the second metal trace is on a second layer of the plurality of layers; and a second terminal coupled to the second metal trace.

9. The antenna apparatus of claim 8, wherein each of the first and second modified Polya curve shapes comprises:

an order, a line width, and a shaping factor, wherein at least one of the order, the line width, and the shaping factor is of a value such that the first or second metal trace substantially covers the first or second polygonal shape and provides desired antenna properties.

10. The antenna apparatus of claim 8, wherein each of the first and second polygonal shapes comprises at least one of: an isosceles triangle, an equilateral triangle, an orthogonal triangle, an arbitrary triangle, a rectangle, a pentagon, a hexagon, and an octagon.

11. The antenna apparatus of claim 8, wherein at least one of the first and second metal traces comprises:

an extension metal trace to tune antenna properties of the antenna structure.

12. The antenna apparatus of claim 8, wherein the antenna structure comprises at least one of:

the first and second metals trace configured to provide a microstrip patch antenna;

the first and second metal traces configured to provide a dipole antenna;

the first and second metal traces configured to provide a monopole antenna;

the first metal trace configured to provide a first microstrip patch antenna and the second metal trace configured to provide a second microstrip patch antenna;

the first metal trace configured to provide a dipole antenna and the second metal trace configured to provide a second dipole antenna; and the first metal trace configured to provide a first monopole antenna and the second metal trace configured to provide a second monopole antenna.

13. The antenna apparatus of claim 8, wherein at least one of the first and second metal traces comprises:

a plurality of metal trace segments confined within at least one of the first and second polygonal shapes, wherein each of the plurality of metal trace segments has at least one of the first and second modified Polya curve shapes; and a plurality of terminals coupled to the plurality of metal trace segments, wherein the plurality of terminals includes at least one of the first and second terminals.

14. The antenna apparatus of claim 13 further comprises at least one of:

the plurality of metal trace segments coupled to form an antenna array;

the plurality of metal trace segments coupled to form a multiple input multiple output (MIMO) antenna;

the plurality of metal trace segments coupled to form a microstrip patch antenna;

the plurality of metal trace segments coupled to form a dipole antenna; and the plurality of metal trace segments coupled to form a monopole antenna.

15. An antenna apparatus comprises:

a metal trace having a modified Polya curve shape that is confined in a triangular shape, wherein a length-to-area ratio of the metal trace is approximately in a range of 4-to-1 to 7-to-1; and a terminal coupled to the metal trace.

16. The antenna apparatus of claim 15 further comprises:

a second metal trace having the modified Polya curve shape that is confined in a second triangular shape, wherein the first metal trace is juxtaposed to the second metal trace, and wherein a length-to-area ratio of the second metal trace is approximately in the range of 4-to-1 to 7-to-1; and a second terminal coupled to the second metal trace, wherein the metal trace and the second metal trace form a dipole antenna.

17. The antenna apparatus of claim 15, wherein the modified Polya curve shape comprises:

an order, a line width, and a shaping factor, wherein at least one of the order, the line width, and the shaping factor is of a value such that the metal trace substantially covers the polygonal shape and provides desired antenna properties.

18. The antenna apparatus of claim 15, wherein the metal trace comprises:

an extension metal trace to tune antenna properties of the antenna structure.

19. The antenna apparatus of claim 15 further comprises:

a plurality of metal traces, wherein each of the plurality of metal traces has the modified Polya curve shape that is confined in the triangular shape and a length-to-area ratio that is approximately in the range of 4-to-1 to 7-to-1, wherein the plurality of metal traces are arranged to form a polygonal shape, and wherein the plurality of metal traces includes the metal trace; and a plurality of terminals coupled to the plurality of metal traces, wherein the plurality of terminals includes the terminal.

20. The antenna apparatus of claim 19 further comprises at least one of:

the plurality of metal traces coupled to form an antenna array;

the plurality of metal traces coupled to form a multiple input multiple output (MIMO) antenna;

the plurality of metal traces coupled to form a microstrip patch antenna;

the plurality of metal traces coupled to form a dipole antenna; and the plurality of metal traces coupled to form a monopole antenna.

* * * * *